US006489532B1

(12) United States Patent
Brummond et al.

(10) Patent No.: US 6,489,532 B1
(45) Date of Patent: Dec. 3, 2002

(54) DELIVERY SYSTEM FOR MOLTEN SALT OXIDATION OF SOLID WASTE

(75) Inventors: William A. Brummond, Livermore, CA (US); Dwight V. Squire, Livermore, CA (US); Jeffrey A. Robinson, Manteca, CA (US); Palmer A. House, Walnut Creek, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/236,173

(22) Filed: Jan. 25, 1999

(51) Int. Cl.[7] ..... A62D 3/00
(52) U.S. Cl. ..... 588/201
(58) Field of Search ..... 588/201; 423/DIG. 12, 423/DIG. 6, DIG. 5, DIG. 18

(56) References Cited

U.S. PATENT DOCUMENTS 4,602,574 A * 7/1986 Bach et al. ..... 110/346
5,191,154 A * 3/1993 Nagel ..... 588/201
5,390,901 A 2/1995 Gay et al. ..... 266/216
5,398,914 A 3/1995 Gay ..... 266/197
5,434,335 A 7/1995 Brummond et al. ..... 588/201
5,491,280 A 2/1996 Brummond et al. ..... 588/202
5,679,132 A * 10/1997 Rauenzahn et al. ..... 75/528

* cited by examiner

*Primary Examiner*—Wayne A. Langel
*Assistant Examiner*—Jonas N. Strickland
(74) *Attorney, Agent, or Firm*—L. E. Carnahan; Alan H. Thompson

(57) ABSTRACT

The present invention is a delivery system for safety injecting solid waste particles, including mixed wastes, into a molten salt bath for destruction by the process of molten salt oxidation. The delivery system includes a feeder system and an injector that allow the solid waste stream to be accurately metered, evenly dispersed in the oxidant gas, and maintained at a temperature below incineration temperature while entering the molten salt reactor.

12 Claims, 4 Drawing Sheets

DELIVERY SYSTEM FOR MOLTEN SALT OXIDATION OF SOLID WASTE

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to the injection of solid waste materials into a molten salt reactor for flameless destruction. In particular, a cooled, insulated injector bore allows air entrained waste particles to be injected into the molten salt free from incineration or burning.

2. Description of Related Art

The development of environmentally acceptable methods for treatment and disposal of large quantities of solid waste materials has been a research goal of industry and DOE federal laboratories. The current method for disposal of solid wastes is incineration. This method of bulk destruction generates hazardous products from the incomplete combustion of organic material. Safe methods must be devised that can completely combust or treat hazardous and mixed wastes (i.e., waste containing both hazardous and radioactive components) in waste-processing plants.

Molten salt oxidation (MSO) technology is a thermal process that has the inherent capability of completely destroying organic constituents of mixed wastes, hazardous wastes, and energetic (explosive) materials. MSO is ideally suited to the destruction of organic waste in the form of gases, liquids, slurries, sludges, and solids on the order of a few millimeters or less. The process has been used for coal gasification and destroying hazardous organics including PCBs, TCE, mixed waste oils, and energetic (explosive) materials.

Solid waste streams have special requirements that are not addressed by conventional MSO processes. A method is needed to incorporate solid waste materials into MSO operations to provide for a flameless method of destruction. Solid waste materials require careful metering before injection because the particles rise to the top. Each particle must have a sufficient amount of oxygen and ample resonance time in the salt bath so as to completely react before reaching the top, where combustion or "flashing" will occur. A system that injects solids too rapidly into the salt bath will cause the bath to contain unsafe concentrations of waste particles resulting in incineration rather than flameless decomposition. In addition, the waste particles must remain below their charring temperature prior to injection into the bath.

This invention provides a means of injecting solids into a molten salt bath in an accurate and controlled manner that allows solid wastes to be effectively destroyed without incineration. This is accomplished by a specially designed insulated injector bore that uses cooled air to keep the waste particles at an optimum temperature to avoid burning, yet having a de minimus effect on the bath temperature.

SUMMARY OF THE INVENTION

The present invention is a method and a delivery system that allows small particles of solid waste materials to be safely injected into a molten salt reactor and destroyed. This invention allows solid waste particles to be fed directly into the molten salt bath by employing an injector that is submersed in the molten salt bath. The solid wastes that can be destroyed include a wide variety of organic and mixed waste materials, including crucible graphite, plutonium-contaminated leaded gloves, ion exchange resins, wood, paper products, plastics, and hospital wastes.

The waste materials are first ground into workable sizes, typically no larger than about 3 mm. Commercial grinders provide an easy, cost-effective way to reduce the size of these particles. Small particle size is necessary for two reasons: to create particles that can be feasibly metered and diluted with oxidant air, and to ensure that the particles are fully converted during their resonance time in the salt bath. Once the waste materials are reduced to small particles, they are stored in a hopper, accurately metered, diluted with an oxidant gas such as air, and injected into the molten salt reactor toward the bottom of the salt bath.

A metering assembly provides a convenient and accurate means of diluting the solid particles with oxidant air from an attached air line. A vibratory metering device is used to feed the waste particles to a horizontal eductor. Oxidant air flows through the eductor creating a slight suction (venturi) effect on the feeder. The waste particles are entrained with oxidant air in this manner, and the slight suction ensures that the flow is always moving towards the reactor. Accurate metering ensures that all the organic constituents will have a sufficient supply of oxygen to be fully converted into carbon dioxide, water, and nitrogen before reaching the top of the salt bath where oxidation occurs. Proper dilution is also a necessary safety precaution to prevent pressure build-up in the reactor, as gases are generated during chemical reactions that take place in the salt.

Once diluted, the air-entrained waste travels through a conveyor tube and is injected into the molten salt via an injector bore. In order to prevent the waste particles from charring or melting and forming by-products that would clog the injector, the waste must be kept cool prior to injection. To accomplish this, the injector bore is designed with a double-jacketed cooling baffle system in which a continuous flow of cool air circulates. Thermal insulation allows this system to keep the waste cool without significantly affecting the temperature of the molten salt.

The waste is injected near the bottom of the salt bath. Once inside the molten salt bath, the particles begin to float to the top. Injection at the bottom of the bath maximizes the particles' resonance time in the salt and enables all of the organic components of the waste to react with the oxygen in the air. Gaseous waste products such as nitrogen, carbon dioxide, and water vapor are produced from the organic components, while the inorganic components are retained within the molten salt as oxides, metals, or salts and later disposed of after further clean-up.

An objective of the present invention is to provide a method and apparatus to inject cooled solid waste into a molten salt bath to be effectively destroyed without incineration. Other objects and advantages of the present invention will become apparent from the following description and accompanying drawings.

BRIEF DESCRIPTION OF THE DRAWINGS

The accompanying drawings, which are incorporated into and form part of this disclosure, illustrate embodiments of the invention and together with the description, serve to explain the principles of the invention.

DETAILED DESCRIPTION OF THE INVENTION

The present invention is a method and delivery system for injecting small particles of solid waste materials into a molten salt reactor where the organic constituents are destroyed through decomposition to carbon dioxide and water. The waste delivery process is accomplished by a two component system, specifically a feeding system and an injector system, which allows the solid waste particles to be accurately metered and safely diluted with an oxidant gas such as air. The injector system ensures that the particles enter the molten salt such that they can be destroyed only through chemical reactions that occur in the salt bath, and not by incineration, which would occur if the particles were not immersed in the molten salt. The solid wastes that may be destroyed include a diverse assortment of organic and mixed waste materials, including crucible graphite, plutonium-contaminated leaded gloves, ion exchange resins, wood, paper products, plastics, and hospital wastes.

Figure 1:
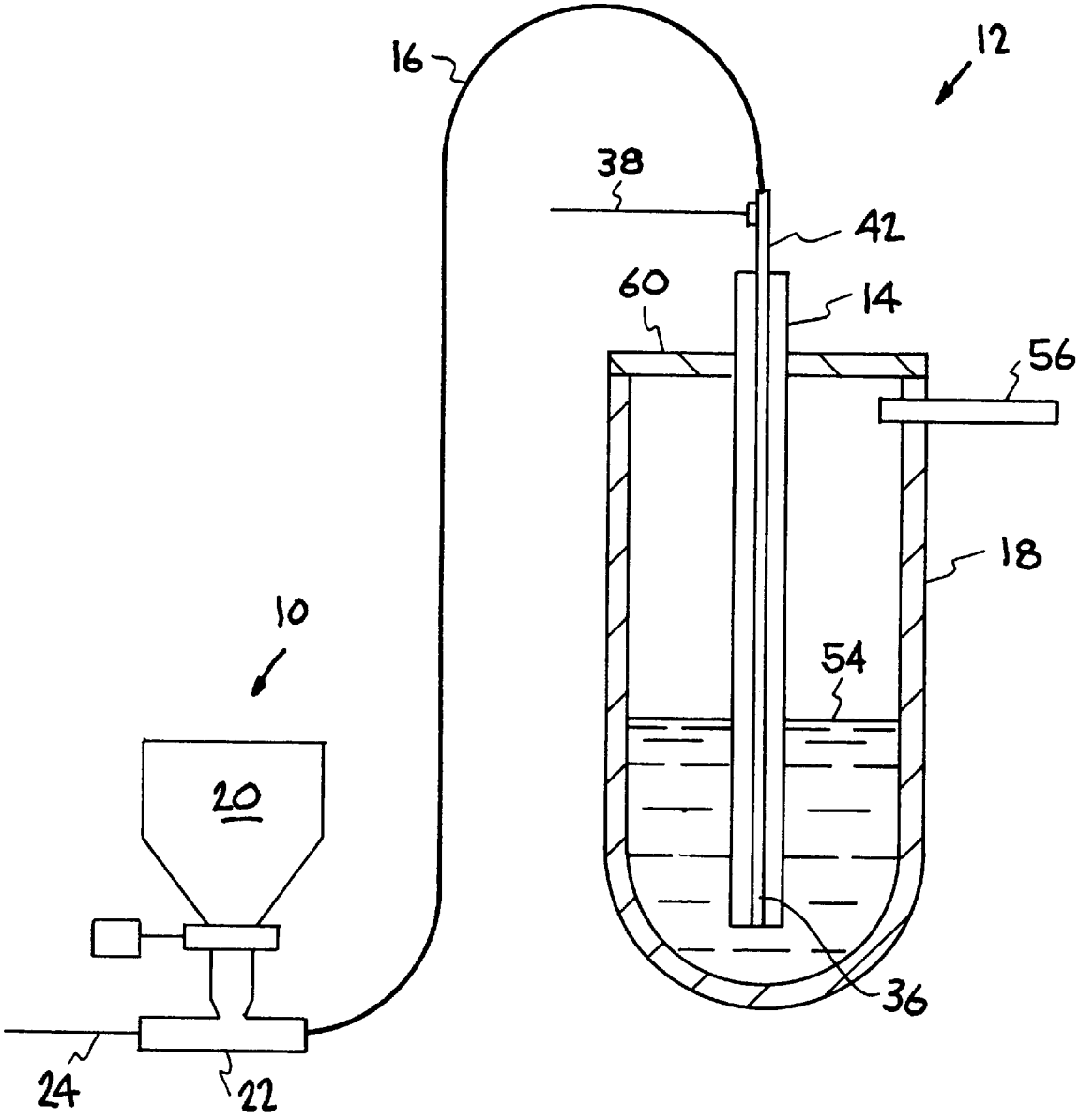
FIG. 1 shows the delivery system into the molten salt reactor.

FIG. 1 shows the two component system including the feeder system 10 and the injector system 12. The feeder system 10 is connected to an injector 14 by a conveyor tube 16. Safety is a major concern in a system where hazardous solid wastes are being destroyed in a high temperature molten salt bath. For this reason, the conveyor tube 16 is flexible, permitting the feeder system 10 to be located away from the molten salt reactor vessel 18, which is maintained at a very high temperature (900–950° C.). This flexible tubing 16 provides convenience in refueling and maintenance.

A continuous flow of air is maintained through the injector 14 and into the salt bath 54, which prevents the molten salt from ever back filling into the injector bore 36. As a safety precaution, the system 12 is equipped with an air bypass line 38 that allows air to flow through the injector bore 36 directly, thus permitting the feeder system 10 to be shut down altogether. The air bypass 38 provides a continuous flow of air through the injector bore 36 safeguarding the system from back filling with molten salt in the event that a clog in the feeding line should ever occur.

Figure 2:
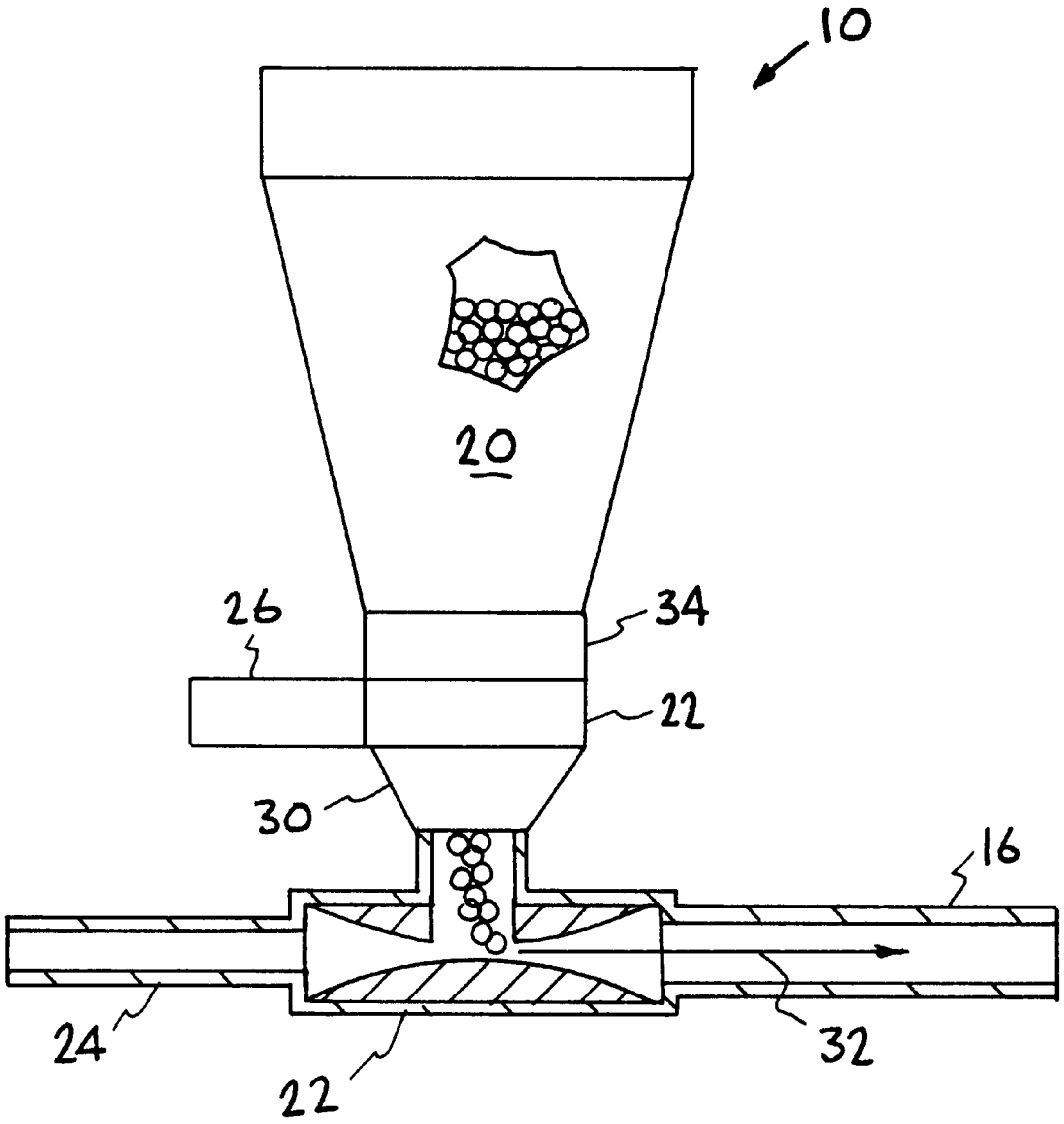
FIG. 2 shows the components of the feeder delivery system.

FIG. 2 is a detailed diagram of the feeder system 10. A waste hopper 20 holds the solid waste materials 28 and can be of almost any size. The hopper 20 may be constructed of any material that is compatible with the waste particles, such as plastic or metal. The waste must have a suitable particle size, so large particles or whole waste material must be ground or shredded prior to entering the hopper 20. Small particle size allows for accurate metering as well as complete destruction of the particle by decomposition.

A variety of metering systems may be employed, and one illustrative embodiment is shown in FIG. 2. A vibrating metering mechanism having a feeder tray 22 and a drive motor 26 distributes the waste from the hopper 20 into an eductor 22. The eductor 22 is a device that uses a jet pump concept to withdraw the particles or powder from one location and eject it into another. Because the hopper 20 is too heavy to rest directly on the tray 22, a collar 34 such as a rubber boot is used to seal the gap between the tray 23 and the hopper 20. Accurate metering is necessary to ensure that each particle is fully converted by decomposition before reaching the top of the salt bath.

Upon passing into the eductor 22, the waste particles are then dispersed and accelerated by an oxidant gas, such as air, which is fed through a compressed air line 24 from a compressor or high pressure gas reservoir (not shown). Typically about 30 psi of air pressure flows through the eductor 22. The eductor 22 contains a small bore in its center, which the air entrained waste stream 32 flows through, limiting the particle size of the waste. Typically, particles that are 3 mm in size are optimal. Positive airflow is maintained because the air flowing through the eductor 22 causes a slight suction effect on the waste particles contained in the hopper 20. This suction ensures that the metered particles immediately become entrained with air as soon as they leave the hopper 20.

The oxidant air acts as a diluent and provides the oxidizing agent necessary for converting the organic constituents of the waste materials into carbon dioxide and water. Sufficient oxygen is crucial to this process; insufficient air will prevent the complete conversion of waste to carbon dioxide, water, and nitrogen, and undesirable carbon compounds such as coke will form. The composition of the waste material determines the rate at which the waste particles will be fed into the molten salt reactor. Typically this rate is between 1 and 3 kilograms per hour.

Figure 3:
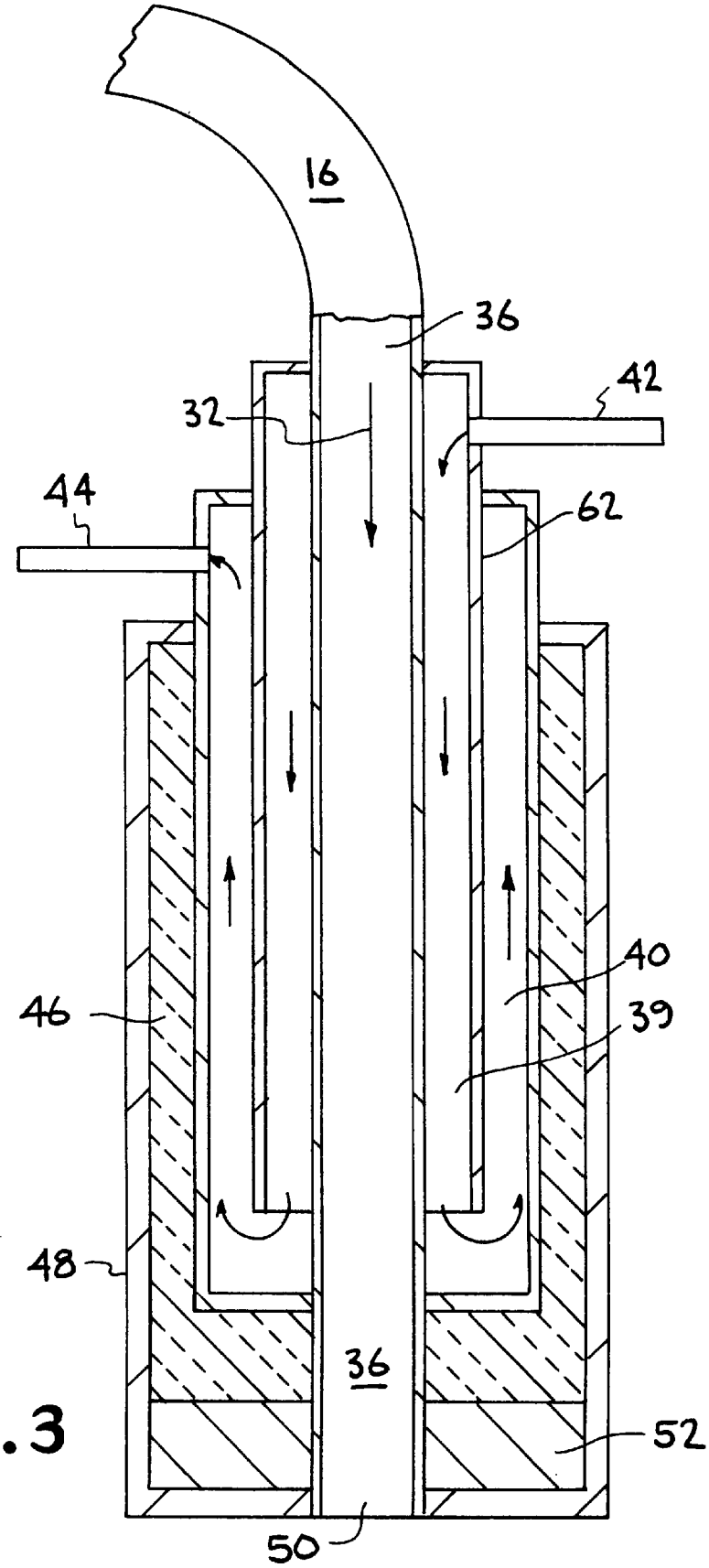
FIG. 3 shows the components of the injector system.

Once metered, the air entrained waste 32 flows from the eductor 22 through the conveyor tube 16 into the injector system 12. FIG. 3 shows an illustrative embodiment of the injector 14. The air-entrained waste 32 passes directly through the conveyer tube 16 into the injector bore 36 and into the molten salt reactor (shown in FIG. 1). The injector bore 36 is typically constructed from a nickel-based high temperature alloy (e.g., steel containing 76% Ni, 8% Fe, and 15.5% Cr, such as Inconel 600®). While in the injector 14, the waste must be kept below its charring temperature to prevent the solid particles from burning or melting.

To accomplish this goal, the injector 14 passes through vessel head 60 and comprises a cooling system with several concentric tubes or cylinders. At the very center of the injector is the injector bore 36, which is a small diameter tube running from the conveyer tube 16 to the molten salt bath 54. The injector bore 36 is surrounded by a double-jacketed cooling baffle 62, having an inner cylinder 39 and an outer cylinder 40. An outermost tube is the injector's housing 48, which is in contact with the molten salt bath and made from a high temperature alloy such as Inconel 600®.

A continuous flow of cooling air 42 is introduced from above the vessel head 60 to the inner cylinder 39 of the cooling baffle and continuously flows along the injector bore 36 in a downward direction. The cooling air then flows from the inner portion of the baffle near the bottom of the reactor bore 36 to the outer cylinder 40 of the baffle in an upwards direction, where the air exits via the cooling air outlet 44. Air, as opposed to water or another liquid coolant, is used for safety reasons. In the event there is a breach in the lines of the baffle system, an air leak will not adversely affect the process, whereas a liquid coolant leak could cause a steam explosion. The cooling baffle 62 is surrounded by thermal insulation 46, typically a ceramic material such as Zircar™ (87% $ZrO_2$, 8% $Y_2O_3$, and 5% $SiO_2$). The insulation 46 serves two purposes: to reduce the heating of the cooling air from the molten salt by thermal conduction, and to reduce the cooling of the molten salt from the cooling air by the same process.

The cooling baffle 62 does not extend to the very bottom of the injector bore 36, but stops short (e.g., by about 30 centimeters). In addition, the thermal insulation 46 stops short of the very bottom (e.g., by about 15 centimeters). The end of the injector bore 50 is surrounded by a high temperature alloy 52, such as Inconel 600®, to provide a thermal mass that keeps the temperature of the walls of the injector above the melting point of the salt. The molten salt 54 has a tendency to creep up along the inside walls of the injector bore 36, which, if allowed to cool, can cause clogging problems. This design effectively keeps the solid waste particles below their combustion temperature prior to entering the salt bath, while at the same time ensuring that all of the salt remains in the molten phase.

Referring to FIG. 1, the waste must be fed into the molten salt 54 near the bottom of the vessel 18 to ensure that the waste particles are destroyed by decomposition and not burning. Once the solid particles enter the molten salt, they begin floating to the top. When the waste particles are immersed directly into the salt bath with oxidant air, chemical reactions take place between the solid particles and the molten salt, which result in the organic constituents being converted to carbon dioxide, steam, and nitrogen, which exit through the off-gas port 56. The inorganic constituents are captured and entrained in the salt. Because the reactor temperature is so high (900–950° C.), the solid particles would instantly burn or incinerate if they reached that temperature without being in the presence of the molten salt. Thus, incineration can only be avoided by keeping the waste particles below their combustion temperature prior to entering the reactor and by ensuring that the waste particles fully react once submerged in the molten salt. Injecting at or near the bottom of the reactor maximizes the residence time of the particles in the salt bath, allowing sufficient time for reaction.

Figure 4:
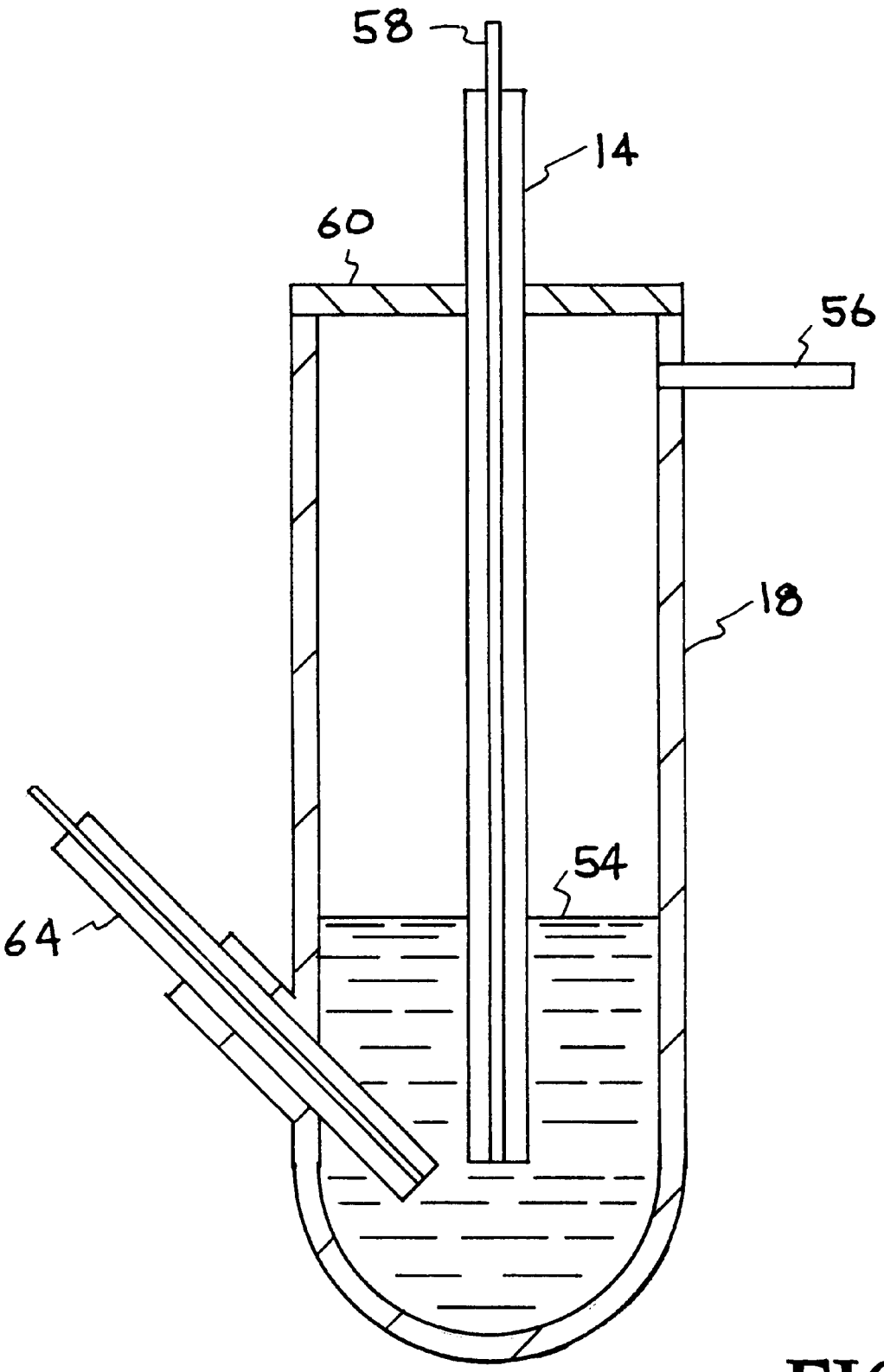
FIG. 4 shows injector locations into the body of the molten salt reactor.

FIG. 4 shows two possible alternative sites where the injector port may be placed. A top port 58 and a side port 64 location are shown. Either location will work with the system described herein. An advantage to having a side port 64 is that the injector length is much shorter, resulting in less area to cool. However, it is sometimes necessary to remove the injector 14 from the reactor for cleaning purposes, and with the side injector location 64, the salt bath 54 must be drained before removing the injector 14. The top port 58 allows for easy removal of the injector without disruption of the salt bath. If a large system is employed, it may be desirable to have several injector locations in a reactor unit.

EXAMPLE

Several forms of solid waste materials have been successfully and safely destroyed. A technology demonstration unit was built and used to destroy material waste including shredded rubber gloves and booties, ion exchange resins, activated charcoal and paper, and cloth rags that were pelletized. The experimental unit was charged with 160 kilograms of molten sodium carbonate, resulting in a salt bath 105 centimeters deep. A camera was installed just above the salt bath so that experimenters could monitor the system for flashing. Flashing describes material that did not completely react in the salt bath and instantaneously ignited upon contact with the air above the salt bath. Minor flashing occurred with most solid waste feeds. The most flashing was observed with plastics, while almost no flashing was detected with ion exchange resins. The flashing that did occur did not cause any significant problems or disrupt the fluent operation of the system in any way.

Typical feed rates were 1–3 kg/hr, and the average run time was 2–3 hours. The types of waste particles introduced into the reactor determined the feed rate and airflow. Each matrix material was run independently. Metering accuracies were within 5% error with an accuracy of 0.4% being obtained for the ion exchange resins.

Gas produced during the decomposition was sent through a conventional scrubbing system to abate CO and $NO_x$. The system monitored CO, $CO_2$, $NO_x$, total hydrocarbons, $O_2$, and $SO_2$. Very little gas was produced, and the levels of gases monitored were well below allowable limits. Applicants have demonstrated that solid waste materials can be safely and completely destroyed using the molten salt destruction process.

The foregoing description of preferred embodiments of the invention is presented for purposes of illustration and description and is not intended to be exhaustive or to limit the invention to the precise form disclosed. Many modifications and variations are possible in light of the above teaching.

What is claimed is:

1. A method for injecting solid waste materials into a molten salt reactor for destruction, comprising:

entraining solid waste particles in an oxidant gas; maintaining the temperature of the waste particles below their combustion temperature; and injecting the solid waste particles into a molten salt bath having a temperature in the range from about 900 degrees C. to about 950 degrees C.

2. The method as recited in claim 1, wherein the oxidant gas is air.

3. The method as recited in claim 1, further comprising controlling the flow rate of the oxidant gas.

4. The method as recited in claim 1, further comprising metering the solid waste particles that are injected into the molten salt bath.

5. The method as recited in claim 1, wherein maintaining the temperature is carried out by flowing a cooling fluid adjacent to the solid particles entrained in oxidant gas before injection into the molten salt bath.

6. The method as recited in claim 1, wherein injecting the waste particles is carried out near the bottom of the molten salt bath.

7. The method of claim 1, wherein the solid waste particles are metered evenly into the oxidant gas.

8. The method of claim 1, wherein injecting the waste particles is carried out so as to immerse the waste particles in the molten salt bath.

9. The method of claim 1, wherein injecting the waste particles is carried out so as to maximize residence time of the waste particles in the molten salt bath.

10. A method for injecting solid waste materials into a molten salt reactor for destruction, comprising:

entraining solid waste particles into an oxidant gas;

maintaining the temperature of the waste particles below their combustion temperature; and injecting the solid waste particles into a molten salt bath having a temperature in the range from about 900 degrees C. to about 950 degrees C. from above the molten bath.

11. The method of claim 10, wherein the solid waste particles are metered evenly into the oxidant gas.

12. A method for injecting solid waste materials into a molten salt rector for destruction, comprising:

entraining solid waste particles in an oxidant gas;

maintaining the temperature of the solid waste particles below their combustion temperature;

injecting the solid waste particles into a molten salt bath having a temperature in the range from about 900 degrees C. to about 950 degrees C.; and wherein said solid waste particles are selected from the group consisting of graphite, resins, wood, paper, plastics, and hospital wastes.

* * * * *